US008132855B2

(12) United States Patent
Richard

(10) Patent No.: US 8,132,855 B2
(45) Date of Patent: Mar. 13, 2012

(54) ONE-PIECE 3-POSITION LEG REST MEMBER FOR FURNITURE MEMBER

(75) Inventor: Marshall E. Richard, Monroe, MI (US)

(73) Assignee: La-Z-Boy Incorporated, Monroe, MI (US)

( * ) Notice: Subject to any disclaimer, the term of this patent is extended or adjusted under 35 U.S.C. 154(b) by 451 days.

(21) Appl. No.: 12/350,414

(22) Filed: Jan. 8, 2009

(65) Prior Publication Data

US 2010/0171355 A1 Jul. 8, 2010

(51) Int. Cl.
*A47C 1/037* (2006.01)

(52) U.S. Cl. ..... 297/84; 297/423.28; 297/463.1; 297/463.2

(58) Field of Classification Search ..... 297/423.26, 297/423.28, 463.1, 463.2, 84; 248/418, 420, 248/421
See application file for complete search history.

(56) References Cited

U.S. PATENT DOCUMENTS

| | | | | |
|---|---|---|---|---|
| 3,325,210 A | | 6/1967 | Knabusch et al. | |
| 4,844,536 A | * | 7/1989 | Mizelle | 297/84 X |
| 5,570,927 A | | 11/1996 | LaPointe et al. | |
| 5,729,304 A | * | 3/1998 | Lim | 348/830 |
| 6,035,464 A | | 3/2000 | Williams | |
| 6,655,732 B1 | | 12/2003 | LaPointe | |
| 7,338,132 B2 | | 3/2008 | LaPointe | |
| 2007/0040439 A1 | | 2/2007 | LaPointe | |
| 2007/0158980 A1 | * | 7/2007 | LaPointe et al. | 297/84 |

FOREIGN PATENT DOCUMENTS

| | | | |
|---|---|---|---|
| GB | 2085293 A | * | 4/1982 |
| JP | 2004-024702 | | 1/2004 |

OTHER PUBLICATIONS

International Search Report of the International Searching Authority for PCT/US2009/069558 dated Aug. 23, 2010.
Written Opinion of the International Searching Authority for PCT/US2009/069558 dated Aug. 23, 2010.

* cited by examiner

*Primary Examiner* — Anthony D Barfield
(74) *Attorney, Agent, or Firm* — Harness, Dickey & Pierce, P.L.C.

(57) ABSTRACT

A furniture member leg rest ratcheting member for temporarily retaining a leg rest assembly in multiple extended positions includes a one-piece homogeneous member having a first portion including at least two cavities each defining a leg rest assembly extended position. A second portion has a male engagement tongue. A third portion has opposed first and second bracket engagement members spaced from each other. The third portion is elastically deflectable with respect to the first and second portions to permit a furniture mechanism bracket to be received between the first and second bracket engagement members when the male engagement tongue of the second portion is engaged with the furniture member bracket and to allow a ratcheting motion of the first and second portions with respect to the third portion.

19 Claims, 12 Drawing Sheets

FIG 10
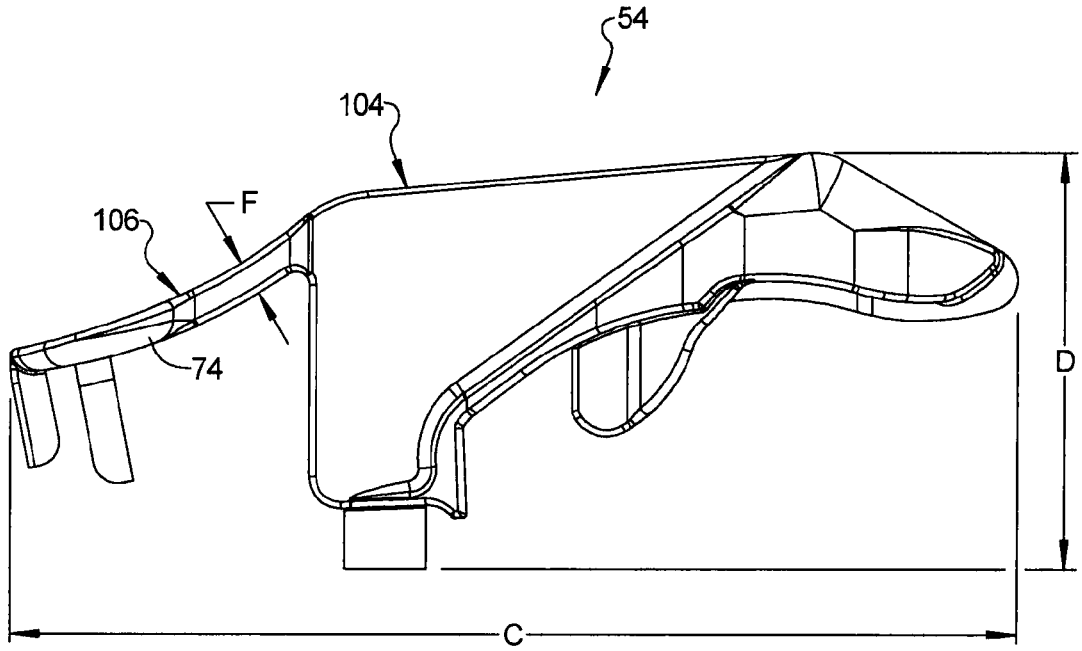
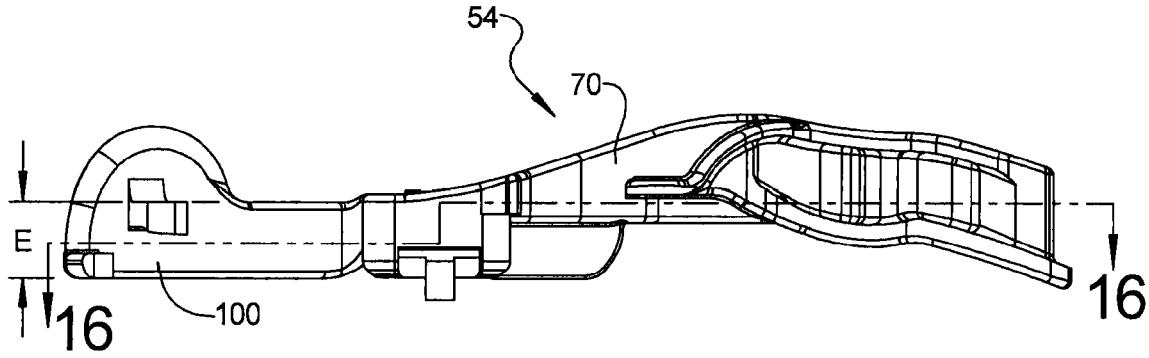
FIG 11

ONE-PIECE 3-POSITION LEG REST MEMBER FOR FURNITURE MEMBER

FIELD

The present disclosure relates to extendable leg rest mechanisms for furniture members including reclining and rocking furniture members.

BACKGROUND

The statements in this section merely provide background information related to the present disclosure and may not constitute prior art.

Traditionally, furniture members such as reclining chairs are equipped with an actuation mechanism which is operatively interconnected between a prefabricated chair frame and a stationary base assembly. The actuation mechanism is typically a combination of various mechanical linkages operable for providing various comfort features such as independent reclining movement of a seat assembly as well as actuation of an extensible leg rest assembly and associated tilting of the chair frame.

While many conventional reclining furniture members operate satisfactorily, furniture manufacturers are continually striving to develop improved frames and actuation mechanisms for reducing system complexity and smoothness of operation as well as occupant comfort. Furthermore, there is a continuing desire to develop improved fabrication and assembly techniques which will result in reduced costs while promoting increased efficiency and improved product quality.

In conventional actuation mechanisms, a latching or ratcheting device is provided with the mechanism that allows the leg rest assembly to extend through multiple latched or supported positions for operator comfort. Known latching devices include detent assemblies having multiple sector plates each having multiple arcuate peripheral edges that engage a pin to temporarily latch the leg rest assembly in one of the extended positions. The sector plates can be provided of a metal such as steel or aluminum and are connected using one or more fasteners. To reduce ratcheting noise, the sector assembly commonly includes a compressible element interposed between the sector plates made of a polymeric or rubber material to receive the pin as the pin moves between the various arcuate peripheral edges. The multiple parts of known latching or detent assemblies add to the overall cost and construction complexity of the furniture member.

SUMMARY

According to several embodiments of the present disclosure, a furniture member leg rest ratcheting member adapted to receive an extending portion of a link of a furniture member actuation mechanism for temporarily retaining a leg rest assembly in multiple extended positions includes a one-piece homogeneous member. The member includes a free end having a raised engagement portion including first and second cavities defining first and second stop positions for a leg rest assembly when the extending portion of the link individually enters each of the first and second cavities. A deflectable portion is homogeneously connected to the free end. The deflectable portion is adapted to be elastically deflectable to permit the free end to move in a ratcheting motion when the extending portion of the link moves between the first and second stop positions.

According to further embodiments, a furniture member leg rest positioning device adapted for temporarily retaining a leg rest assembly in a plurality of extended positions includes a homogenous polymeric one-piece member. The member includes a first portion having at least two cavities defining first and second leg rest assembly extended stop positions. A second portion homogeneously connected to the first portion has a male engagement tongue extending therefrom. A third portion homogeneously connected to the second portion has opposed first and second bracket engagement members spaced from each other. The third portion is adapted to be elastically deflectable with respect to the first and second portions.

According to further embodiments, a one-piece homogeneous furniture member leg rest ratcheting member adapted for temporarily retaining a furniture member leg rest assembly in a plurality of extended positions includes a first portion having first and second raised engagement portions. The first raised engagement portion includes a cavity adaptable to create a first leg rest assembly extended position, and a second cavity created between the first and second raised engagement portions. The second cavity is adaptable to create a second leg rest assembly extended position. A second portion is homogeneously connected to the first portion having a male engagement tongue extending therefrom oppositely directed from each of the first and second raised engagement portions. A third portion homogeneously connected to the second portion has opposed first and second bracket engagement members spaced from and positioned parallel to each other. The third portion is adapted to be elastically deflectable with respect to the first and second portions.

According to still further embodiments, the first portion has first and second raised engagement portions. The first raised engagement portion includes a cavity defining a first stop position adaptable to create a first leg rest assembly extended position, and a second cavity defining a second stop position created between the first and second raised engagement portions, the second cavity adaptable to create a second leg rest assembly extended position.

According to still further embodiments, a furniture member leg rest positioning system includes a one-piece ratchet device of a polymeric material including a first portion having first and second raised engagement portions. The first raised engagement portion includes a first cavity adaptable to create a first leg rest assembly extended position, and a second cavity created between the first and second raised engagement portions, the second cavity adaptable to create a second leg rest assembly extended position. A second portion homogeneously connected to the first portion has a male engagement tongue extending therefrom oppositely directed from each of the first and second raised engagement portions. A third portion homogeneously connected to the second portion is adapted to be elastically deflectable with respect to the first and second portions. A furniture member mechanism link having a link extending member is selectively receivable in each of the first and second cavities and operable to temporarily retain a furniture member leg rest assembly in each of the first and second extended positions.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

FIG. 10 is a top plan view of the one-piece 3-position member of FIG. 5;

FIG. 11 is a side elevational view of the one-piece 3-position member of FIG. 10;

DETAILED DESCRIPTION

Figure 1:
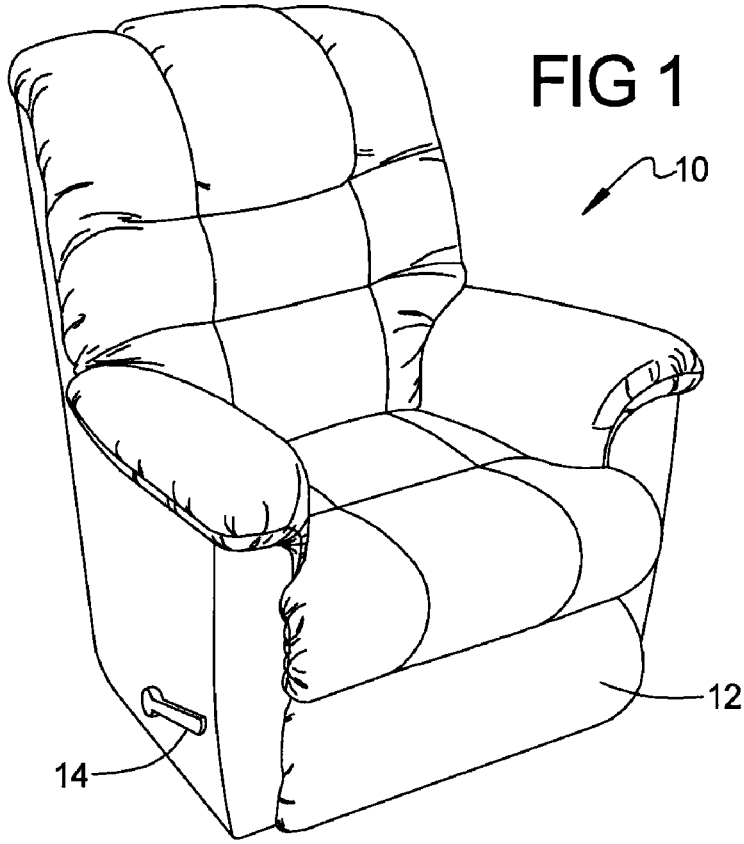
FIG. 1 is a front perspective view of a furniture member having an extensible leg rest.

The following description is merely exemplary in nature and is not intended to limit the present disclosure, application, or uses. It should be understood that throughout the drawings, corresponding reference numerals indicate like or corresponding parts and features.

In accordance with the teachings of the present disclosure, a multiple position leg rest member for use in single and multi-person articles of furniture (i.e.: chairs, sofas and/or loveseats) is disclosed. A general understanding of the art to which the present disclosure pertains is disclosed in U.S. Pat. No. 3,325,210, Adjustable Leg Rest Locking Device, U.S. Pat. No. 5,570,927, Modular Wall Proximity Reclining Chair, and U.S. Pat. No. 6,655,732, Multiple Position Leg Rest Mechanism For A Reclining Chair, which are commonly owned by the assignee of the present mechanism and the disclosure of which is expressly incorporated by reference herein. As will be described, the pre-assembled actuation mechanism permits a leg rest assembly to pivot in a 3-position movement from upholstered frame components so as to provide precise mechanical alignment and superior structural rigidity while concomitantly facilitating application of highly efficient fabrication and assembly processes.

The term "homogeneous" as used herein is defined as a part, component, member, or the like (collectively the part) having all portions of the part formed of the same material and by the same process used to create the part, such as by molding including injection molding, or casting, such that no portion(s) of the part require connection to any other portion by a secondary process including but not limited to welding, adhesive bonding, mechanical connection, second molding or casting process, or the like, and the chemical properties of the part material are substantially equivalent throughout the part.

Figure 2:
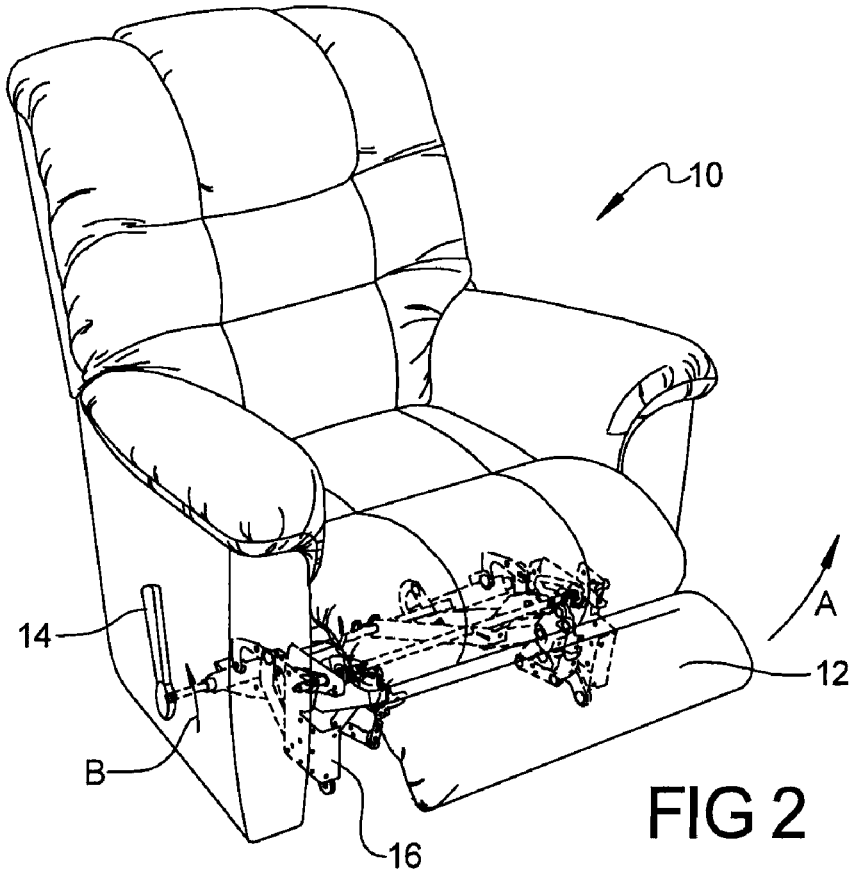
FIG. 2 is a front perspective view similar to FIG. 1 further showing a furniture member leg rest partially extended.

With reference to FIGS. 1 and 2, the article of furniture shown is a combination wall proximity recliner and tilt chair, hereinafter referred to as a chair 10. A leg rest assembly 12 is extensible in an arc of rotation "A" from a stowed position abutting chair 10 (shown in FIG. 1) to an extended position (shown in FIG. 2) using a hand lever 14 connected to an actuation mechanism 16. In one aspect of the disclosure, hand lever 14 is rotated counterclockwise about an arc of rotation "B" to extend leg rest assembly 12, and can be oppositely rotated to return leg rest assembly 12 from the extended to the stowed position. Actuation mechanism 16 and various upholstered frame components can also be assembled as a modular seating unit. It should be understood that the elements of actuation mechanism 16 and leg rest assembly 12 are not limited to use with chair 10, but are applicable for use in virtually any type of single or multi-person article of furniture. As such, the particular structure of the various subassemblies and components which, when assembled, define chair 10 are merely intended to illustrate but one furniture application to which the present disclosure is applicable.

Referring now generally to FIG. 3 and again to FIG. 1, actuation mechanism 16 includes a drive rod 18 integrated into and rotatably supported from a chair frame 19 and, in one aspect, from left and right side frame assemblies 20, 22 defining a drive rod axis of rotation 24. Actuation mechanism 16 can further include a front support shaft 25, which together with drive rod 18 are spatially oriented to be located and "suspended" from right and left side frame assemblies 20, 22. In some aspects, drive rod 18 is an elongated rectangular-shaped metal shaft having manually-operable hand lever 14 (shown in FIG. 1) secured thereto proximate an upholstered exterior portion of one of the right or left side frame assemblies 20, 22. Hand lever 14 can therefore be easily reached by an occupant seated in chair 10 for convenient actuation of drive rod 18.

Leg rest assembly 12 is supported for extensible movement using actuation mechanism 16. More specifically, mechanism 16 includes a right and a left pantograph linkage 26, 28 and a spring-assisted toggle assembly 30 which are operably associated with drive rod 18 and front support shaft 25 for permitting the seat occupant to selectively actuate leg rest assembly 12 in response to rotation of drive rod 18 via hand lever 14. Mechanism 16 can also include right and left support shaft mounting brackets 31, 32, and right and left leg rest support brackets 34, 36. In addition to side frame assemblies 20, 22, chair frame 19 can also include a front rail member 38 which, when interconnected to right and left leg rest support brackets 34, 36, defines rigid "box-like" chair frame 19.

A first and a second connecting link 40, 41 convert the rotational motion of drive rod 18 to longitudinally translate right and left hand pantograph linkages 26, 28. Leg rest assembly 12 is both supported and moved by right and left pantograph linkages 26, 28 and right and left leg rest support brackets 34, 36. In some aspects of the disclosure, right and left pantograph linkages 26, 28 are identical. Right and left pantograph linkages 26, 28 are suspended about a set of "fixed" suspension points defined by front support shaft 25. The extensible action of leg rest assembly 12 takes place simultaneously for both the right and left pantograph linkages 26, 28 when there is sufficient angular rotation of drive rod 18 via hand lever 14.

In general, the structural frame components such as side frame assemblies 20, 22 and front rail member 38 are each constructed in a manner which enables them to support springs, padding, upholstery, and the like in order to complete a decorative and stylish chair 10. For example, the upholstery shown in FIG. 1 can be applied to each outward facing side of side frame assemblies 20, 22 and to a forward facing side 42 of front rail member 38. Each frame component is individually preassembled for subsequent modular assembly into chair 10. However, it is to be understood that the specific construction shown for each frame component is merely exemplary in nature.

Figure 4:
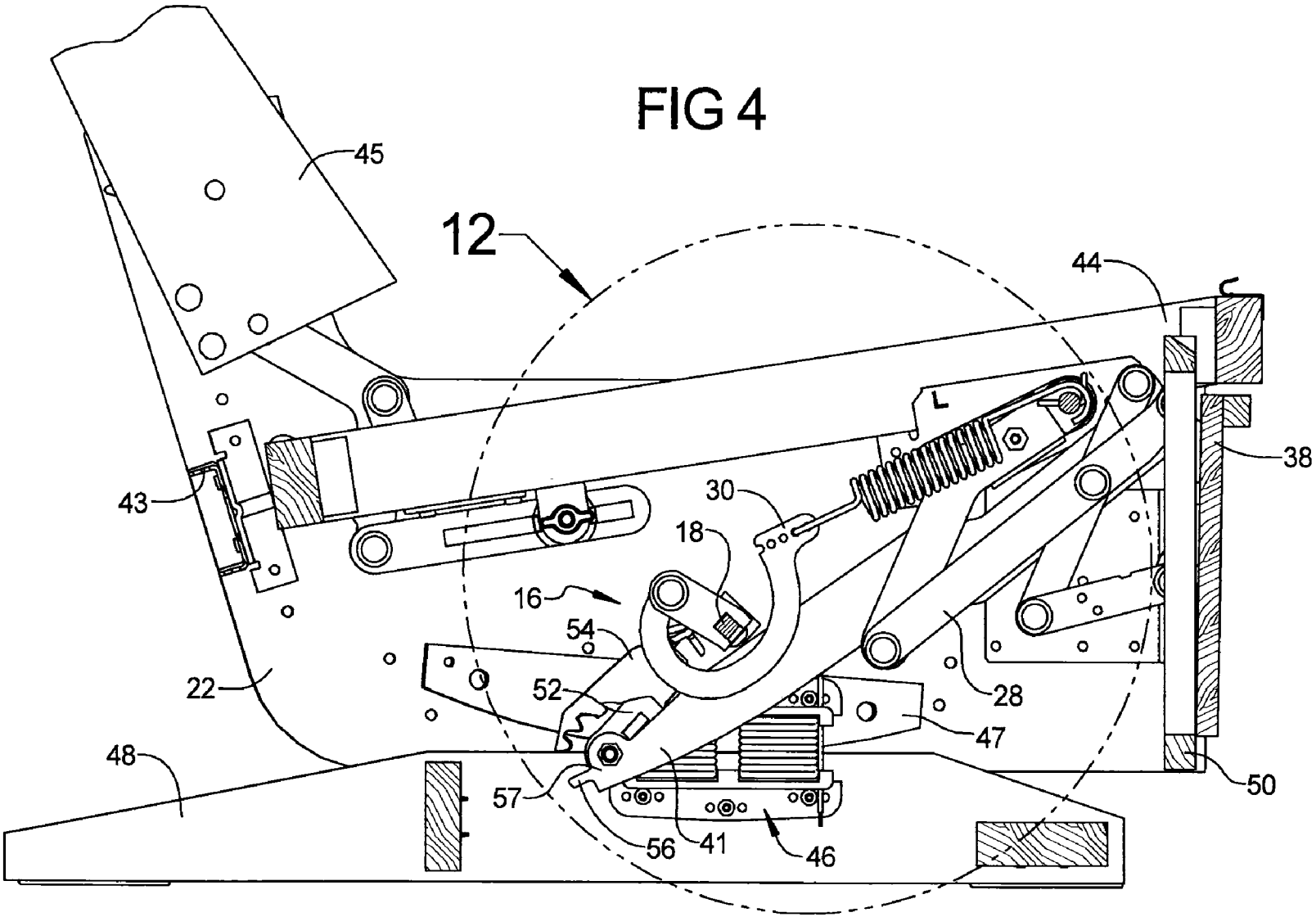
FIG. 4 is a cross sectional side elevational view of the furniture member operating mechanism of FIG. 3 adapted to provide for an extensible leg rest.

With specific reference to FIG. 4, chair frame 19 can further include a rear rail member 43 which provides additional frame stiffness, an occupant seat support pan or member 44, and at least one occupant back support member 45. Mechanism 16 is connected to each of right and left side frame assemblies 20, 22 which in turn can be supported using a spring assembly 46 between a rocker block 47 connected to each of right and left side frame assemblies 20, 22 and a base assembly 48 which is duplicated on the right side of chair 10. A front frame member 50 can also be provided to structurally support an area from which front rail member 38 is extensible.

Mechanism 16 can further include a bracket 52 which is coupled at one end for rotation to drive rod 18 and rotatably coupled at a second end to second connecting link 41. A ratcheting member or 3-position leg rest member 54 of the present disclosure is connected to bracket 52 and is adapted to be engaged by an extending member 56 extending from an end 57 of second connecting link 41. Mechanism 16 and leg rest assembly 12 in FIG. 4 are shown in a stowed position having front rail member 38 and each of right and left pantograph linkages 26, 28 in their fully retracted positions.

Figure 5:
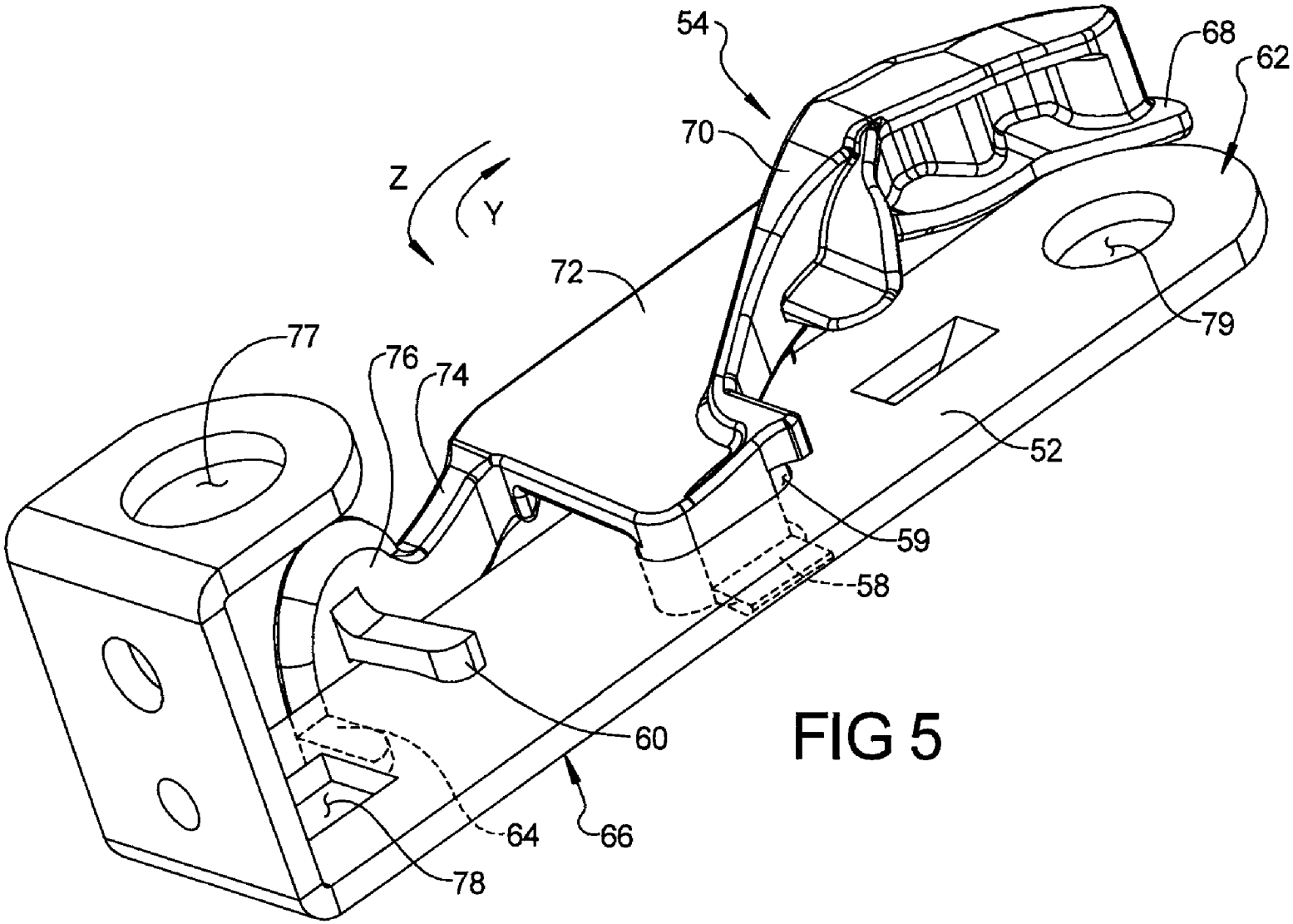
FIG. 5 is a front perspective view of a one piece 3-position member and bracket assembly of the present disclosure.

Referring to FIG. 5, 3-position leg rest member 54 is shown in its connected position with bracket 52. 3-position leg rest member 54 is coupled to bracket 52 using a first bracket engagement member or first engagement tongue 58 inserted into an aperture 59 of bracket 52, a second bracket engagement member or second engagement tongue 60 in contact with a first surface 62 of bracket 52, and a third engagement member or third engagement tongue 64 located proximate to second engagement tongue 60 but being positioned in contact with an opposite facing second surface 66 with respect to second engagement tongue 60. First engagement tongue 58 has a width greater than a width of aperture 59 so that first engagement tongue 58 must be tipped before being slidingly inserted into aperture 59, while the width of aperture 59 permits limited translation of first engagement tongue 58 and therefore 3-position leg rest member 54 to permit a ratchet or ratcheting (elastic back-and-forth) motion of 3-position leg rest member 54. The first engagement tongue 58 can be oriented parallel to the bracket second and third engagement tongues 60, 64. When mounted as shown, 3-position leg rest member 54 provides a first member portion defining a free end 68 which is joined by a connecting portion 70 to a second member portion defining a body portion or member body 72. Second and third engagement tongues 60, 64 are deflectable with respect to member body 72 using a third member portion defining a spring arm 74. Second and third engagement tongues 60, 64 are homogenously connected to a manual deflection tab 76 which is elastically deflectable to allow connection of second and third engagement tongues 60, 64 to bracket 52 by manually outwardly pressing on manual deflection tab 76 after first engagement tongue 58 is inserted into aperture 59. Free end 68 is elastically deflectable with respect to member body 72 in the installed position.

Figure 3:
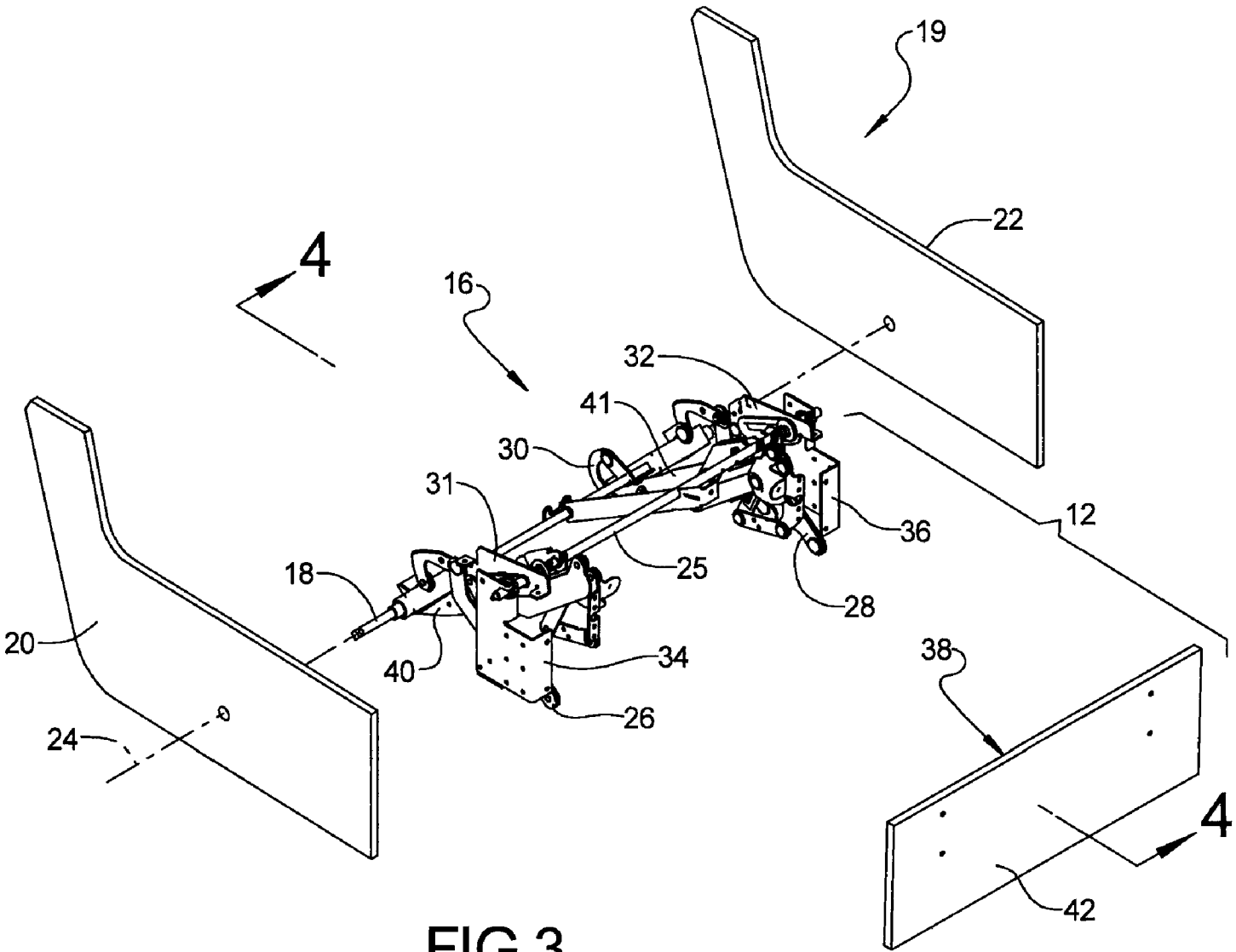
FIG. 3 is a front perspective view of a partial frame and actuation mechanism for the furniture member of FIG. 1.

Bracket 52 includes a circular drive rod rotation clearance aperture 77 and a drive rod engagement aperture 78 sized and geometrically shaped to slidably receive and engage drive rod 18 shown in FIG. 3. Bracket 52 further includes a pin receiving aperture 79 adapted to rotatably fasten bracket 52 to first and second connecting links 40, 41 (an exemplary pinned connection to second connecting link 41 is shown in FIG. 4). 3-position leg rest member 54 is mounted to bracket 52 by first inserting first engagement tongue 58 into aperture 59 of bracket 52. Manual deflection tab 76 is then elastically deflected away from bracket 52 in the direction of an arc "Y" to allow second and third engagement tongues 60, 64 to be positioned as shown in contact with first and second surfaces 62, 66 respectively. The spring action or biasing force of spring arm 74 when manual deflection tab 76 is deflected provides an elastic return force in the direction of an arc "Z" to hold or retain 3-position leg rest member 54 in the orientation shown.

Figure 6:
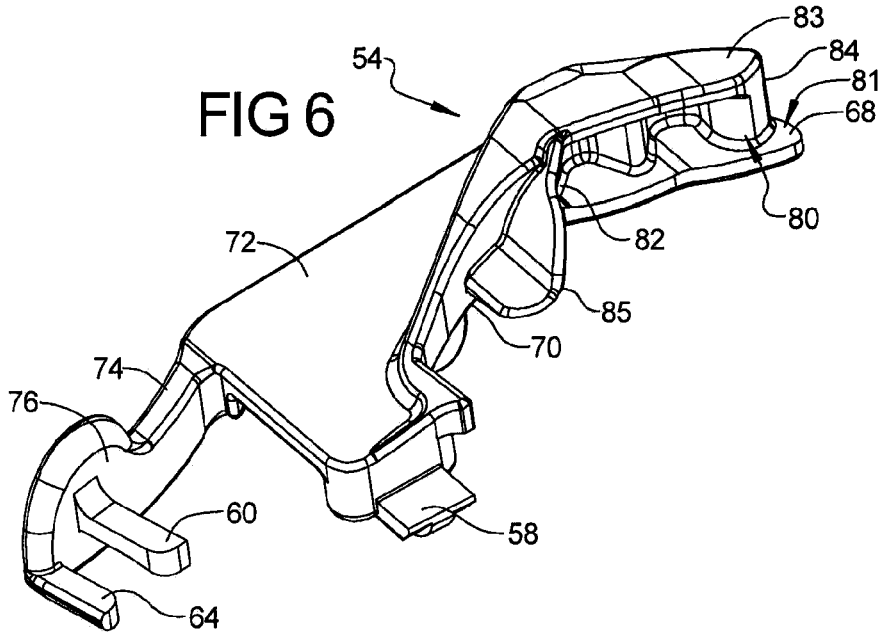
FIG. 6 is a front perspective view of the one-piece 3-position member of FIG. 5.

Referring to FIG. 6, 3-position leg rest member 54 is provided as a homogeneous one-piece part made for example from an injection molding process from a polymeric material such as a polyamide material. 3-position leg rest member 54 further includes a raised engagement portion 80 and a transition portion 82 which co-extend outwardly from a same side or surface 81 of free end 68. A flange 83 defines an end surface oriented substantially parallel to surface 81 and integrally connected with and extending beyond most of the raised engagement portion 80 and at least partially over the transition portion 82. Raised engagement portion 80 is positioned proximate to a leading edge 84 of free end 68. A stiffening wing member 85 extends outwardly from connecting portion 70 and flange 83 proximate to transition portion 82. Each of the connecting portion 70, first, second and third engagement tongues 58, 60, and 64, spring arm 74, and manual deflection tab 76 are homogeneously connected to and integrally made a part of 3-position leg rest member 54.

Figure 7:
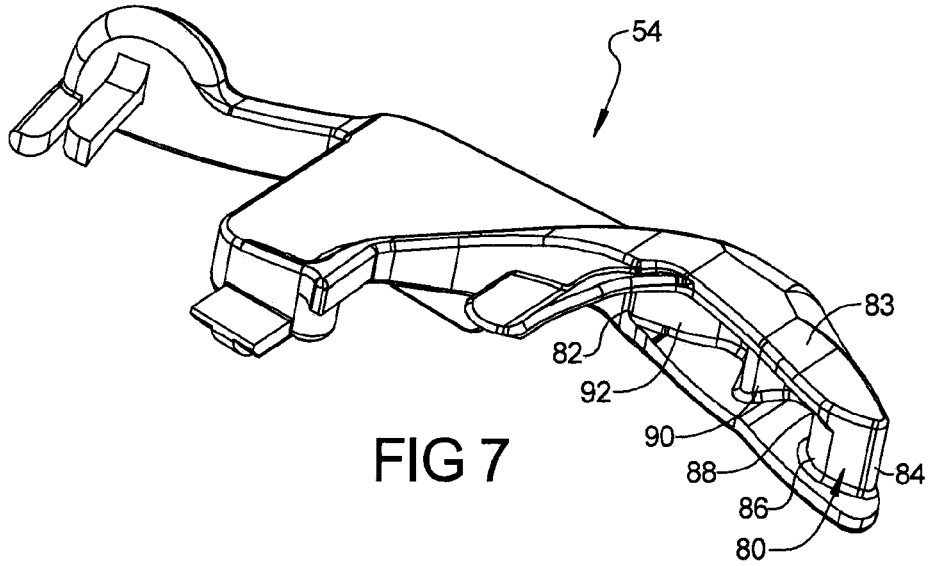
FIG. 7 is a rear perspective view of the one-piece 3-position member of FIG. 5.

Referring to FIG. 7 and again to FIG. 4, 3-position leg rest member 54 further includes a first convex surface 86 extending smoothly from leading edge 84, a concave-shaped slot or first cavity 88, and a second convex surface 90 each created on raised engagement portion 80. Transition portion 82 is provided with a concave surface 92 facing raised engagement portion 80. Each of these features are adapted to receive or be contacted by extending member 56 of either first or second connecting links 40, 41 which will be described in greater detail in reference to FIGS. 12 through 15.

Figure 8:
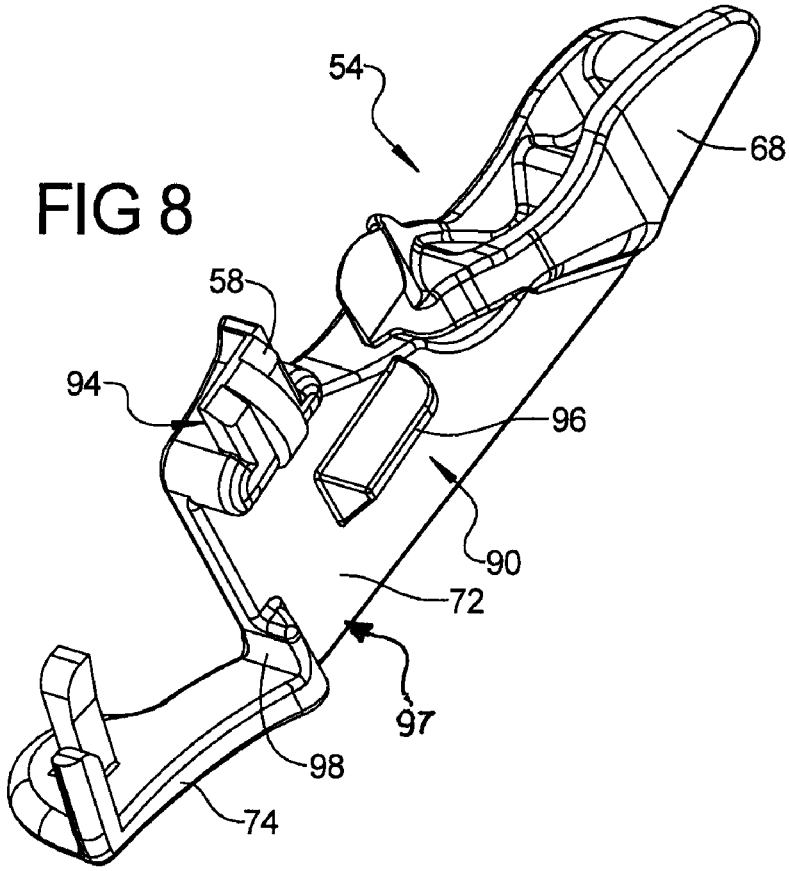
FIG. 8 is a bottom perspective view of the one-piece 3-position member of FIG. 5.

Referring now to FIG. 8 and again to FIGS. 5 and 6, a bracket contact face 94 is provided with first engagement tongue 58 which contacts bracket 52 (as shown in FIG. 5) when first engagement tongue 58 is received in aperture 59. A bracket contact wall 96 also homogeneously and transversely extends from a lower-surface 97 of 3-position leg rest member 54, defined as a surface of free end 68 oppositely directed from surface 81 from which raised engagement portion 80 and transition portion 82 extend. A radiused junction 98 can be provided between member body 72 and spring arm 74. Radiused junction 98 reduces the potential for the bending stresses at the junction between spring arm 74 and member body 72 to cause stress risers when spring arm 74 is elastically deflected.

Figure 9:
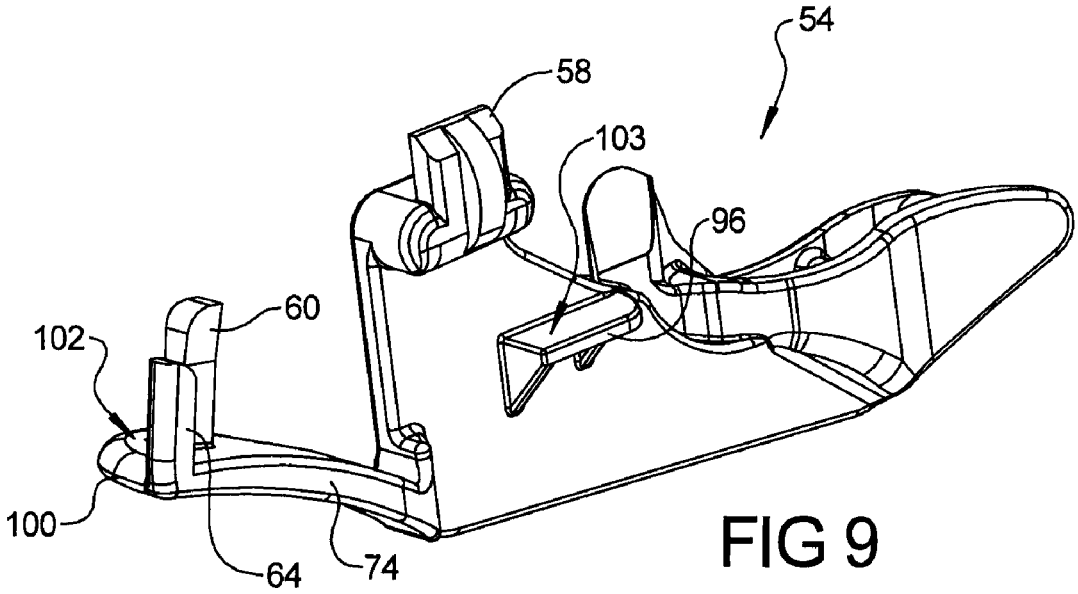
FIG. 9 is a rotated bottom perspective view of the one-piece 3-position member of FIG. 8.

Referring to FIG. 9 and again to FIG. 5, third engagement tongue 64 is positioned proximate to an end face 100 of spring arm 74. A first bracket engagement surface 102 is created proximate to and oriented transverse to end face 100 from which third engagement tongue 64 homogeneously extends. A second bracket engagement surface 103 is provided on a first engagement tongue 58 facing side of bracket contact wall 96. First and second bracket engagement surfaces 102, 103 can be parallel with each other to provide contact with bracket 52 when 3-position leg rest member 54 is mounted on bracket 52.

Referring to FIGS. 10 and 11, 3-position leg rest member 54 can further include an outer wall 104 which smoothly transitions into a concave shaped outer wall 106 of spring arm 74. 3-position leg rest member 54 has a total length "C" and a total width "D", a spring arm width "E", and a connecting portion thickness "F". The geometry of 3-position leg rest member 54 can be varied based on the material selected, the amount of spring force required for spring arm 74, and to permit variations in the overall geometry to accommodate use in various mechanisms.

Figure 12:
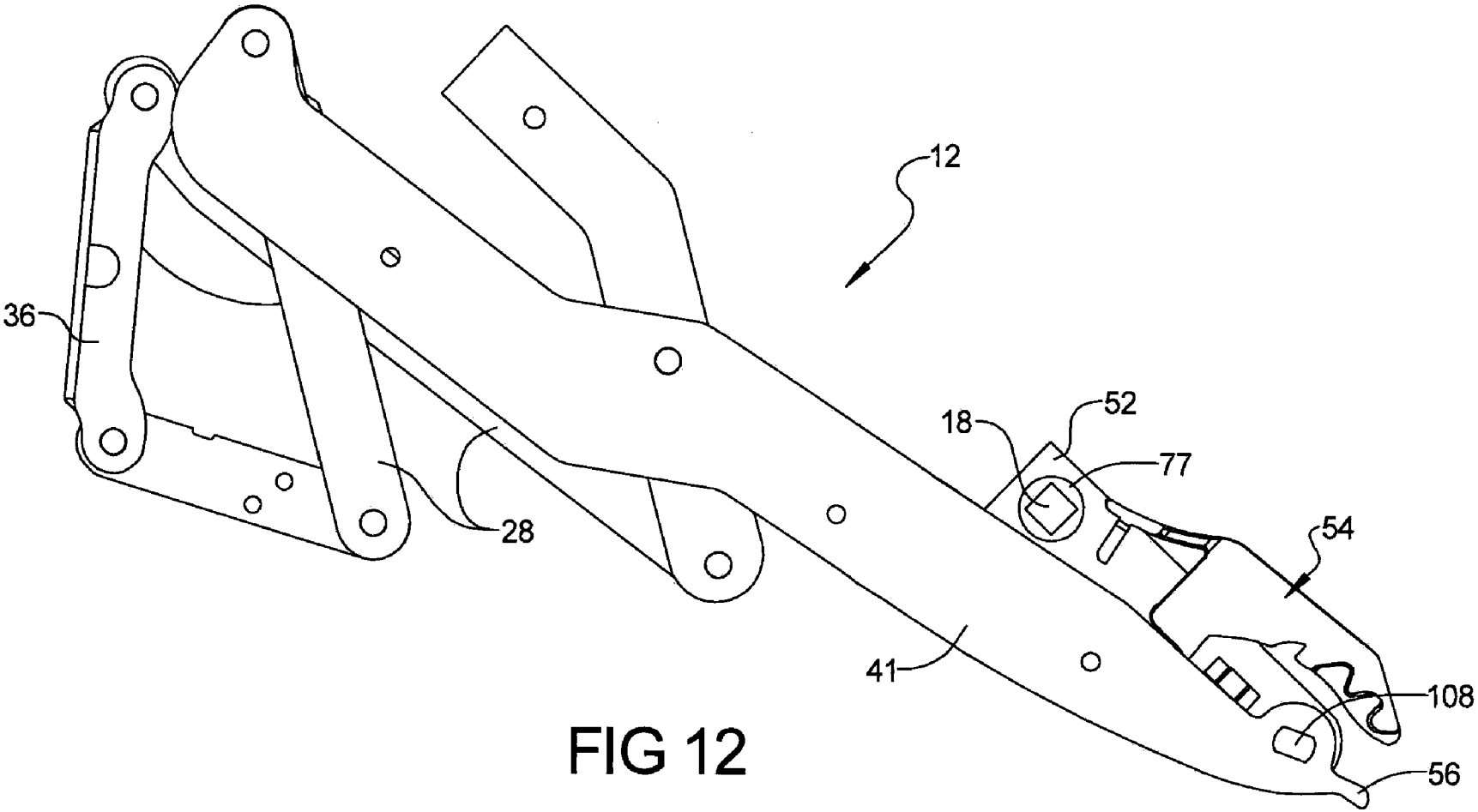
FIG. 12 is a side elevational view of an assembly of the one piece 3-position member and bracket assembly of FIG. 5 connected to a left hand pantograph linkage portion of the mechanism of FIG. 3, shown in a fully retracted position.

Referring to FIG. 12, a portion of leg rest assembly 12 including left pantograph linkage 28, left leg rest support bracket 36, and second connecting link 41 is shown rotatably connected to bracket 52 which has one of the 3-position leg rest members 54 connected thereto. The stowed position of leg rest assembly 12 is shown in FIG. 12. In the stowed position, extending member 56 of second connecting link 41 is rotated freely away from and out of contact with 3-position leg rest member 54. A pin 108 is provided to rotatably connect bracket 52 with second connecting link 41. Drive rod 18 is disposed through bracket 52 including through clearance aperture 77. A similar arrangement (not shown) is also provided for the right side components of leg rest assembly 12.

Referring to FIG. 13 and again to FIGS. 5 and 6, a first extended position of leg rest assembly 12 is shown. The first extended position is provided by rotating drive rod 18, which is rotatably coupled to bracket 52 which as previously noted is rotatably coupled to second connecting link 41 by pin 108. When drive rod 18 is rotated, bracket 52 rotates through an arc of rotation "G" about a longitudinal axis defined through drive rod 18. This rotation initially directs extending member 56 of second connecting link 41 into contact with first convex surface 86 of raised engagement portion 80. Contact between extending member 56 and first convex surface 86 causes elastic deflection of free end 68 and member body 72 through bending of spring arm 74 of 3-position leg rest member 54 permitting displacement about a member deflection arc "J" until extending member 56 snaps into first cavity 88. When extending member 56 is positioned proximate to first cavity 88, the elastic biasing force of spring arm 74 biases 3-position leg rest member 54 to elastically return in a return deflection arc "K". This back-and-forth or ratcheting motion of free end 68 and member body 72 by deflection of spring arm 74 is provided by the elastic biasing capability of spring arm 74 and the sliding clearance of first engagement tongue 58 within aperture 59 of bracket 52. Engagement of extending member 56 within first cavity 88 provides a retention capability to temporarily provide the first extended position of leg rest assembly 12, and first cavity 88 therefore defines a first stop position for leg rest assembly 12. In the first stop position left leg rest support bracket 36 extends outwardly about a leg rest extension arc "H".

Referring to FIG. 14 and again to FIG. 5, a second extended position of leg rest assembly 12 is created by further rotation of drive rod 18. As bracket 52 further rotates about arc of rotation "G", extending member 56 is displaced from first cavity 88 and slides along second convex surface 90 once again elastically outwardly deflecting free end 68 and member body 72 of 3-position leg rest member 54 about member deflection arc "J". The second extended position is created when extending member 56 is repositioned into a slot or second cavity 110 created between raised engagement portion 80 and transition portion 82. At this time, the elastic biasing force of spring arm 74 biases 3-position leg rest member 54 about return deflection arc "K" to establish the second extended position of leg rest assembly 12. Second cavity 110 therefore defines a second stop position of leg rest assembly 12. At the second stop position, left leg rest support bracket 36 is further outwardly extended about leg rest extension arc "H".

Referring to FIG. 15 and again to FIGS. 5 and 6, a third or fully extended position of leg rest assembly 12 is shown. In the fully extended position, drive rod 18 has been fully rotated to position bracket 52 substantially parallel with second connecting link 41. During this rotation, extending member 56 displaces from second cavity 110 and deflects 3-position leg rest member 54 in member deflection arc "J" as extending member 56 displaces past transition portion 82. The fully extended position is achieved when extending member 56 is freely positioned or out of contact with 3-position leg rest member 54, and left leg rest support bracket 36 is fully extended about the leg rest extension arc "H" as shown. Extending member 56 contacts a portion of wing member 85 (not shown in this view for clarity) to support the weight of an occupant's legs on leg rest assembly 12 in the fully extended position which defines a third stop position of the leg rest assembly. Leg rest assembly 12 can be returned from the fully extended position shown in FIG. 15 to the stowed or fully retracted position shown in FIG. 12 by rotating drive rod 18 in an opposite rotational direction to return bracket 52 and second connecting link 41 to the position shown in FIG. 12.

Figure 13:
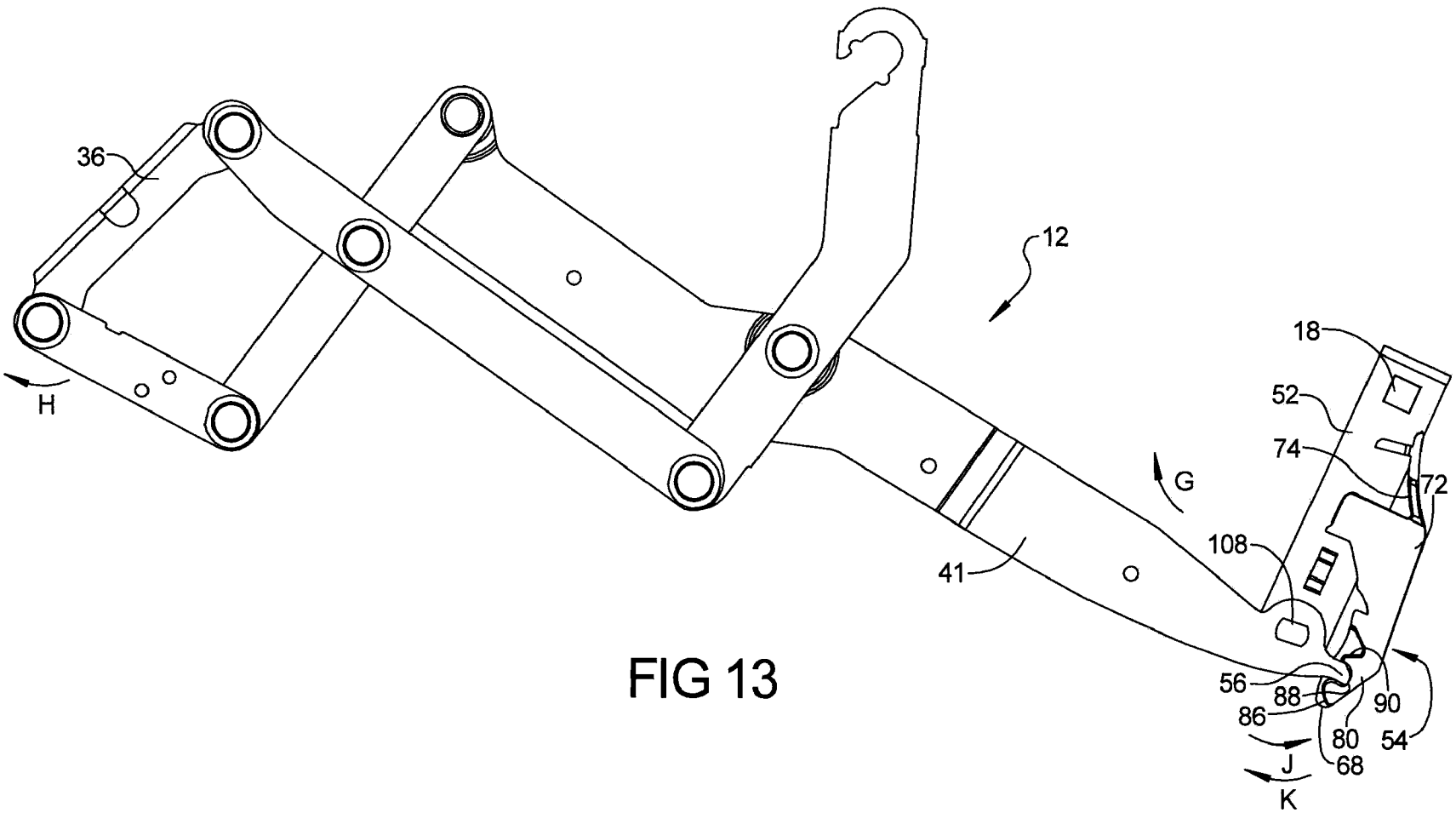
FIG. 13 is a side elevational view of the assembly of FIG. 12 shown in a first partially extended position.
Figure 14:
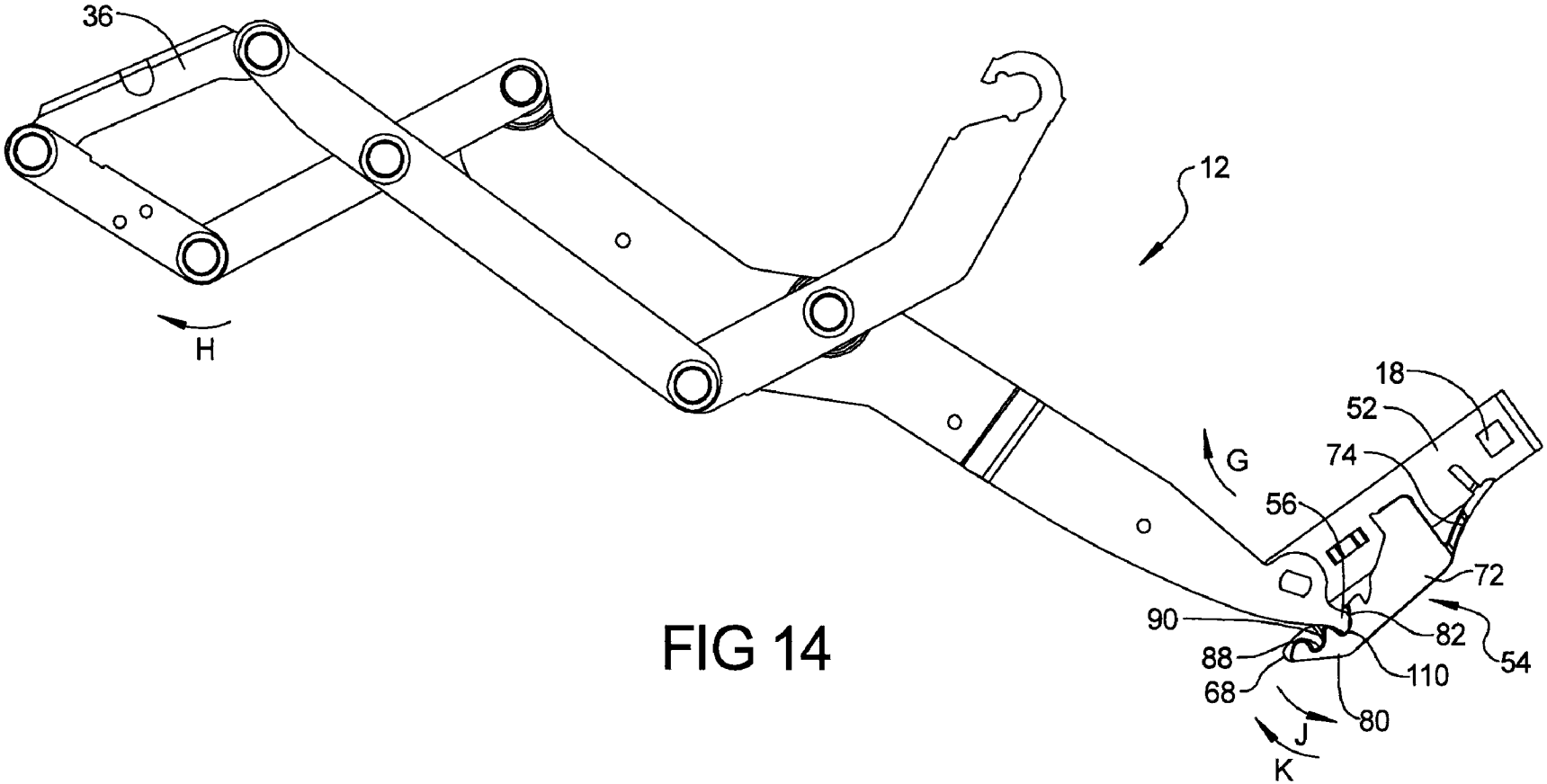
FIG. 14 is a side elevational view of the assembly of FIG. 12 shown in a second partially extended position.
Figure 15:
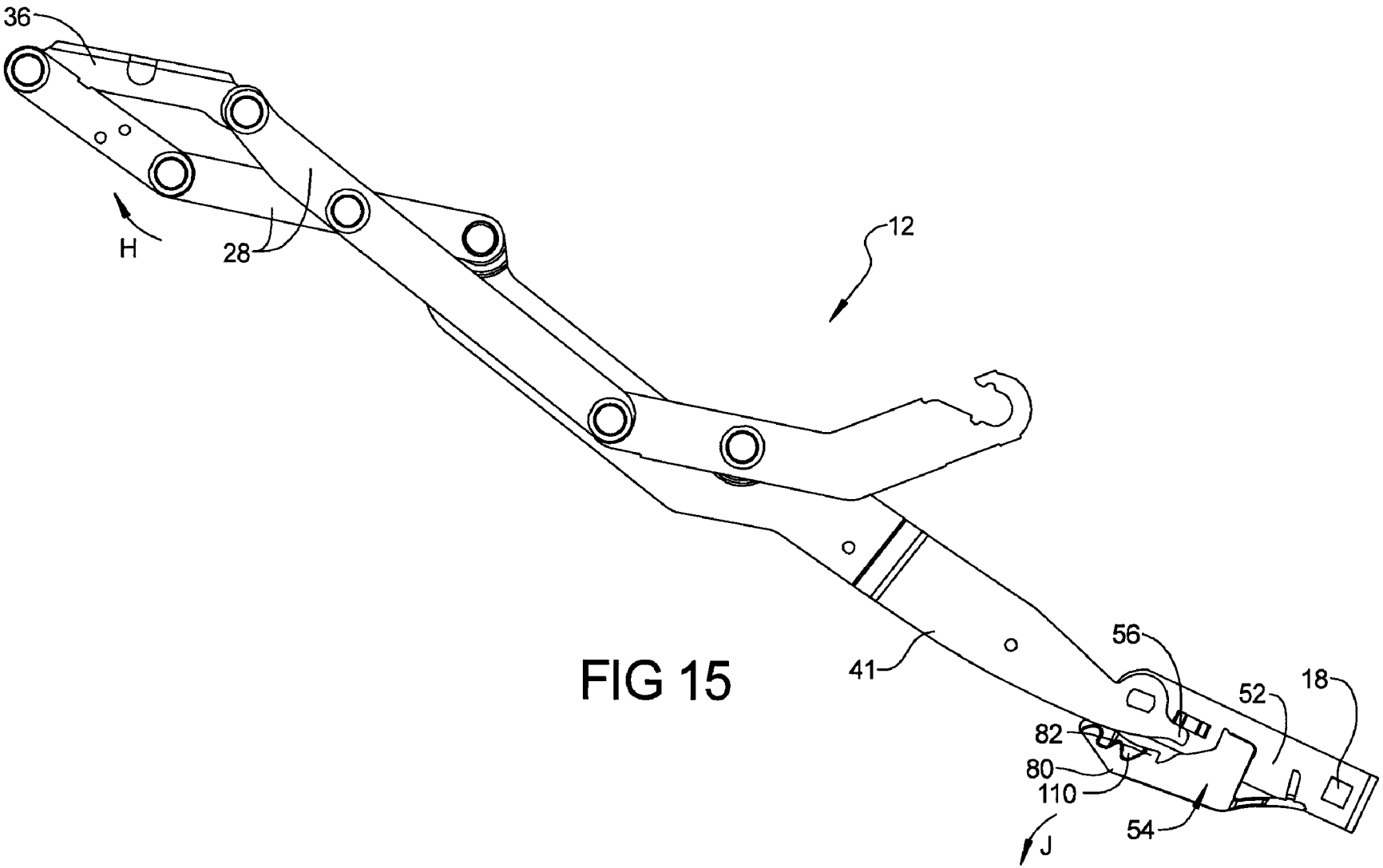
FIG. 15 is a side elevational view of the assembly of FIG. 12 shown in a third fully extended position.
Figure 16:
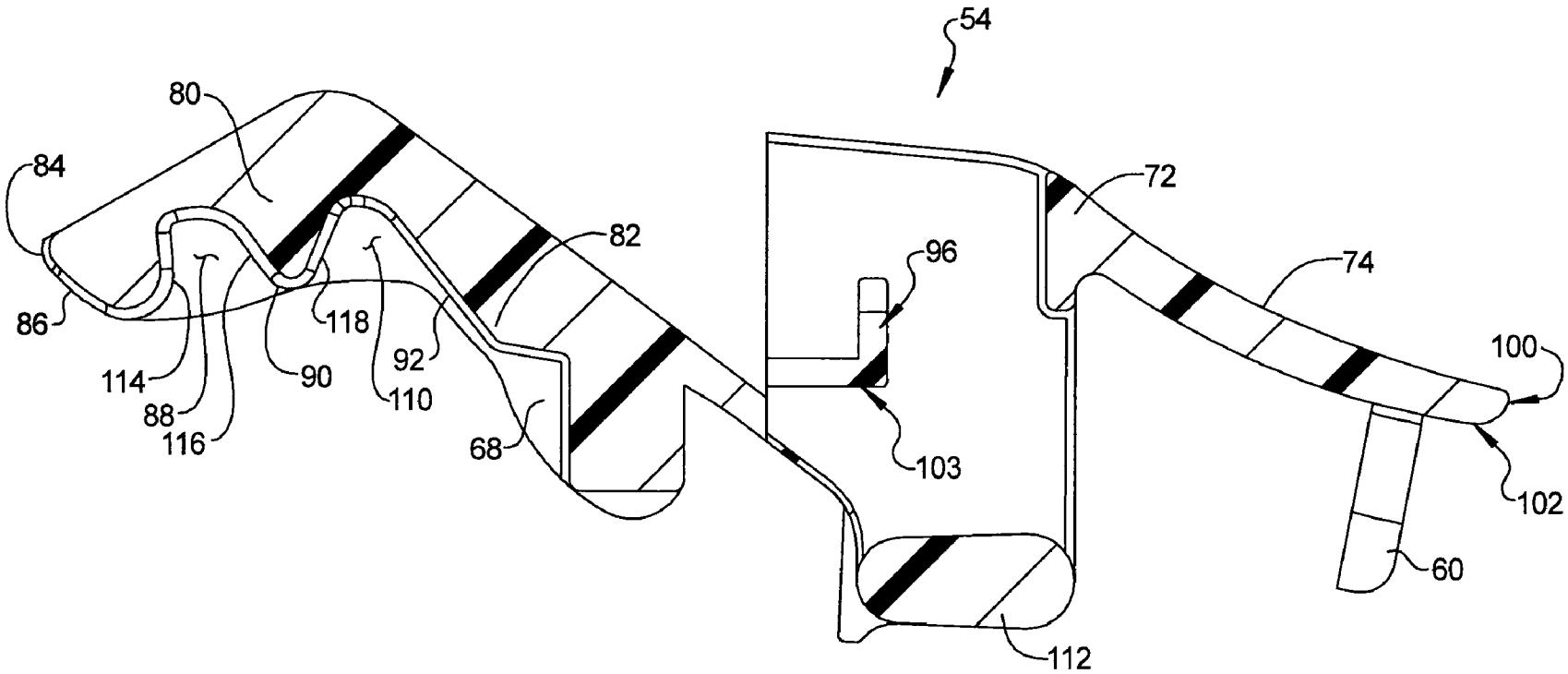
FIG. 16 is a cross sectional top plan view taken at section 16 of FIG. 11.

Referring to FIG. 16 and again to FIGS. 13-15, a continuous-wall transition is defined by the continuous wall created by leading edge 84, first convex surface 86, first cavity 88, second convex surface 90, second cavity 110, and concave surface 92. The continuous-wall transition reduces friction allowing a smooth sliding motion of extending member 56 over these surfaces between the various stop/extended positions of the leg rest assembly 12. A support post 112 provides support for first engagement tongue 58 (not visible in this view). Opposed first and second walls 114, 116 are spaced from each other creating a width of first cavity 88 which is greater than a width of extending member 56 allowing extending member 56 to be partially received in first cavity 88. Similarly, a third wall 118 is spaced from concave surface 92 creating a width of second cavity 110 which is also greater than the width of extending member 56 allowing extending member 56 to be partially received in second cavity 110.

3-position leg rest member 54 provides a one-piece homogeneous member including first, second, and third portions, the first portion (free end 68) having at least two cavities (first cavity 88 and second cavity 110) each defining a leg rest assembly extended position (first and second extended positions). The second portion (member body 72) is connected to the first portion (free end 68) having a male engagement tongue (first engagement tongue 58) extending therefrom. The third portion (spring arm 74) is connected to the second portion (member body 72) and has opposed first and second bracket engagement members (second and third engagement tongues 60, 64) spaced from each other. The third portion (spring arm 74) is adapted to be elastically deflectable to permit a furniture mechanism bracket (bracket 52) to be received between the first and second bracket engagement members (second and third engagement tongues 60, 64) when the male engagement tongue (first engagement tongue 58) of the second portion (member body 72) is engaged with the furniture member bracket (bracket 52).

The 3-position leg rest member 54 of the present disclosure provides several advantages. By creating the 3-position leg rest member 54 entirely from a polymeric material, a smooth wall transition or reduced friction operation is created for transitioning between any of the leg rest assembly stowed and extended positions. A polymeric material also reduces a noise level as the extending member 56 contacts or releases from various engagement portions of the 3-position leg rest member 54. Further, a 3-position leg rest member 54 of the present disclosure does not require any additional fasteners to assemble the 3-position leg rest member into its engaged position with bracket 52. This reduces the quantity of parts required for assembly of mechanism 16, eliminates the need to lubricate the assembly, and simplifies the installation because the 3-position leg rest member 54 of the present disclosure defines a snap-on part requiring no installation tools.

What is claimed is:

1. A furniture member leg rest ratcheting member adapted to receive an extending portion of a link of a furniture member actuation mechanism for temporarily retaining a leg rest assembly in multiple extended positions, comprising:

a one-piece homogeneous member, the member including:

a free end having a raised engagement portion including first and second cavities defining first and second stop positions for a leg rest assembly when the extending portion of the link individually enters each of the first and second cavities;

a deflectable portion homogeneously connected to the free end; the deflectable portion adapted to be elastically deflectable to permit the free end to move in a ratcheting motion when the extending portion of the link moves between the first and second stop positions; and a body portion positioned between the free end and the deflectable portion, having a bracket contact wall transversely extending from the body portion.

2. The furniture member leg rest ratcheting member of claim 1, wherein the body portion includes a support post having a male engagement tongue extending from the support post, the engagement tongue and the support post spatially separated from the bracket contact wall.

3. A furniture member leg rest ratcheting member adapted to receive an extending portion of a link of a furniture member actuation mechanism for temporarily retaining a leg rest assembly in multiple extended positions, comprising:

a one-piece homogeneous member, the member including:

a free end having a raised engagement portion including first and second cavities defining first and second stop positions for a leg rest assembly when the extending portion of the link individually enters each of the first and second cavities; and an elastically deflectable portion homogeneously connected to the free end, the elastically deflectable portion elastically deflecting with respect to the free end to permit the free end to move in a ratcheting motion when the extending portion of the link moves between the first and second stop positions;

wherein the one-piece homogeneous member further includes a flange in integral contact with and at least partially covering the raised engagement portion and a transition portion.

4. A furniture member leg rest positioning device adapted for temporarily retaining a leg rest assembly in a plurality of extended positions, comprising:

a homogenous polymeric one-piece member, the member including:

a first portion having at least two cavities defining first and second leg rest assembly extended stop positions;

a second portion homogeneously connected to the first portion having a male engagement tongue extending therefrom; and a third portion homogeneously connected to the second portion having opposed first and second bracket engagement members spaced from each other, the third portion adapted to be elastically deflectable with respect to the first and second portions, the third portion further including a pad extending transversely with respect to each of the first and second bracket engagement members, the pad adapted to permit manual force application to the third portion to permit elastic deflection of the third portion with respect to the second portion during installation of the leg rest ratcheting member.

5. The leg rest positioning device of claim 4, wherein the second portion further includes a bracket contact wall positioned proximate to the male engagement tongue, the bracket contact wall and the male engagement tongue oppositely directed with respect to the pad.

6. The leg rest positioning device of claim 4, wherein the first portion includes a raised engagement portion having the at least two cavities created in the raised engagement portion.

7. The leg rest positioning device of claim 6, wherein the one-piece member further includes a flange homogenously connected to the raised engagement portion and adapted to at least partially cover the at least two cavities.

8. The leg rest positioning device of claim 6, wherein the raised engagement portion includes a first convex surface and a second convex surface, a first one of the at least two cavities being positioned between the first and second convex surfaces.

9. The leg rest positioning device of claim 6, wherein the one-piece member further includes:

a transition portion extending from the raised engagement portion; and a wing member extending from the transition portion.

10. A one-piece homogeneous furniture member leg rest ratcheting member adapted for temporarily retaining a furniture member leg rest assembly in a plurality of extended positions, comprising:

a first portion having a raised engagement portion, the raised engagement portion including a cavity defining a first stop position for a first leg rest assembly extended position, and a second cavity defining a second stop position for a second leg rest assembly extended position;

a second portion having a male engagement tongue adapted for mounting the ratcheting member; and a third portion extending from the second portion, the third portion having opposed first and second bracket engagement members spaced from and positioned parallel to each other, the third portion adapted to be elastically deflectable with respect to the first and second portions;

wherein the male engagement tongue is oriented parallel to the first and second bracket engagement members.

11. The one-piece homogeneous furniture member leg rest ratcheting member of claim 10, wherein the ratcheting member comprises a polymeric material.

12. A one-piece homogeneous furniture member leg rest ratcheting member adapted for temporarily retaining a furniture member leg rest assembly in a plurality of extended positions, comprising:

a first portion having a raised engagement portion, the raised engagement portion including a cavity defining a first stop position for a first leg rest assembly extended position, and a second cavity defining a second stop position for a second leg rest assembly extended position;

a second portion having a male engagement tongue adapted for mounting the ratcheting member;

a third portion extending from the second portion, the third portion having opposed first and second bracket engagement members spaced from and positioned parallel to each other, the third portion adapted to be elastically deflectable with respect to the first and second portions; and a spring arm elastically connecting the third portion to the second portion.

13. The one-piece homogeneous furniture member leg rest ratcheting member of claim 12, wherein the third portion further includes a manual deflection tab oriented transverse to the first and second bracket engagement members.

14. The one-piece homogeneous furniture member leg rest ratcheting member of claim 13, wherein a force applied to the manual deflection tab operates to elastically deflect the spring arm to displace both the first and second bracket engagement members.

15. A furniture member leg rest positioning system, comprising:

a one-piece polymeric material ratcheting member, including:

a first portion having a raised engagement portion, the raised engagement portion including a first cavity defining a first leg rest assembly extended position, and a second cavity defining a second leg rest assembly extended position;

a second portion homogeneously extending from the first portion having a male engagement tongue oppositely directed from the raised engagement portion; and a third portion homogeneously extending from the second portion and adapted to be elastically deflectable with respect to the first and second portions; and a furniture member mechanism link having a link extending member selectively receivable in each of the first and second cavities operating to temporarily retain a furniture member leg rest assembly in each of the first and second extended positions;

wherein in an engaged position of the ratcheting member the male engagement tongue is slidably received in an aperture of the mechanism bracket and the mechanism bracket is positioned between the first and second bracket engagement members.

16. The leg rest positioning system of claim 15, further comprising an actuation mechanism adapted to control extensible positions of the leg rest assembly, the mechanism link rotatably connected to the actuation mechanism and operable with the ratcheting member to position the leg rest member in the first and second extended positions.

17. The leg rest positioning system of claim 16, wherein the actuation mechanism further comprises:

a mechanism drive rod; and a mechanism bracket adapted for rotation by the drive rod.

18. The leg rest positioning system of claim 17, wherein the third portion homogeneously includes opposed first and second bracket engagement members spaced from each other and adapted to receive the mechanism bracket between the first and second bracket engagement members.

19. The leg rest positioning system of claim 17, comprising a third leg rest extended position defined when the link extending member is in contact with a wing extending from the ratcheting member.

* * * * *

UNITED STATES PATENT AND TRADEMARK OFFICE

CERTIFICATE OF CORRECTION

PATENT NO. : 8,132,855 B2
APPLICATION NO. : 12/350414
DATED : March 13, 2012
INVENTOR(S) : Richard E. Marshall It is certified that error appears in the above-identified patent and that said Letters Patent is hereby corrected as shown below:

Title Page, under Item (12), Delete "Richard" and insert --Marshall--

Title Page, under Item (75), Inventor: "Marshall E. Richard" should be --Richard E. Marshall--

Signed and Sealed this
First Day of May, 2012

David J. Kappos

David J. Kappos
*Director of the United States Patent and Trademark Office*